US007824177B2

(12) United States Patent
Takasu et al.

(10) Patent No.: US 7,824,177 B2
(45) Date of Patent: Nov. 2, 2010

(54) COMBUSTION APPARATUS

(75) Inventors: Yoshihiko Takasu, Nagoya (JP); Hideo Okamoto, Nagoya (JP)

(73) Assignee: Rinnai Corporation, Nagoya-Shi (JP)

( * ) Notice: Subject to any disclaimer, the term of this patent is extended or adjusted under 35 U.S.C. 154(b) by 120 days.

(21) Appl. No.: 11/736,275

(22) Filed: Apr. 17, 2007

(65) Prior Publication Data

US 2007/0248921 A1 Oct. 25, 2007

(30) Foreign Application Priority Data

Apr. 19, 2006 (JP) ..... 2006-115561

(51) Int. Cl.
*F23N 5/00* (2006.01)

(52) U.S. Cl. ..... 431/29; 431/30; 431/31; 431/353; 126/101; 126/116 A; 126/350.1; 122/18.1

(58) Field of Classification Search ..... 431/353, 431/29, 30, 31, 13, 90, 78, 22, 18, 62; 126/101, 126/116 A, 362.1, 350.1, 355.1, 357.1; 122/18.1
See application file for complete search history.

(56) References Cited

U.S. PATENT DOCUMENTS

| | | | | |
|---|---|---|---|---|
| 3,464,184 | A * | 9/1969 | Wright | 422/151 |
| 5,085,576 | A * | 2/1992 | Bonne et al. | 431/22 |
| 5,203,687 | A * | 4/1993 | Oguchi | 431/14 |
| 5,400,962 | A * | 3/1995 | Adams et al. | 236/20 R |
| 5,544,645 | A * | 8/1996 | Armijo et al. | 126/101 |
| 5,636,598 | A * | 6/1997 | Moore, Jr. | 122/18.3 |
| 5,658,140 | A * | 8/1997 | Kondou et al. | 431/90 |
| 5,778,867 | A * | 7/1998 | Osanai | 123/698 |
| 5,938,423 | A * | 8/1999 | Nishiyama et al. | 431/12 |
| 7,062,952 | B2 * | 6/2006 | Gokhfeld | 73/23.31 |
| 2006/0049268 | A1 * | 3/2006 | Weimer et al. | 236/51 |

FOREIGN PATENT DOCUMENTS

| | | |
|---|---|---|
| JP | S54-067238 | 5/1979 |
| JP | H02-115653 | 9/1990 |
| JP | 06-229539 | 8/1994 |

* cited by examiner

*Primary Examiner*—Steven B McAllister
*Assistant Examiner*—Avinash Savani
(74) *Attorney, Agent, or Firm*—Rankin, Hill & Clark LLP

(57) ABSTRACT

Provided is a combustion apparatus that can positively prevent a combustible gas present in the vicinity from catching fire in performing prepurge, which involves exhausting air from a combustion chamber provided with a burner, before igniting the burner. The combustion apparatus 1 contains combustion control means 6 that ignites the burner after performing prepurge by use of a fan 4, and gas detection means 5 that is provided between an air supply port 7 and the fan 4 and detects the concentration of a combustible gas. The combustion control means 6 ascertains, before starting the prepurge, whether a combustible gas of a preset maximum concentration or higher is detected by use of the gas detection means 5 (STEP 1) and prohibits the prepurge by prohibiting the energization of the fan 4 when a combustible gas of the maximum concentration or higher has been detected (STEP 2).

4 Claims, 3 Drawing Sheets

COMBUSTION APPARATUS

BACKGROUND OF THE INVENTION

1. Field of the Invention

The present invention relates to a combustion apparatus that ignites a burner after the prepurge of a combustion chamber.

2. Description of the Related Art

There has hitherto been known a combustion apparatus comprising a burner, a CO sensor, and combustion control means that stops the combustion of the burner when the CO sensor detects carbon monoxide of a prescribed concentration or higher during the combustion of the burner (refer to Japanese Patent No. 3138353, for example).

According to this combustion apparatus, when the CO sensor detects carbon monoxide generated by the incomplete combustion of the burner, it is possible to prevent an increase in the carbon monoxide concentration by stopping the combustion of the burner.

However, because the CO sensor of the conventional combustion apparatus is intended for detecting the carbon monoxide concentration, it does not have performance high enough to detect combustible gasses other than carbon monoxide. For this reason, for example, in a case where the user handles a volatile fuel, such as gasoline, and a combustible gas becomes present near the air supply port of the combustion apparatus, it has been difficult to detect this combustible gas. And if the combustion apparatus is operated when the combustible gas is present near the air supply port like this, it might be thought that the combustible gas catches fire from an electric spark that might be generated by the energization of a fan and by the ignition of the burner.

SUMMARY OF THE INVENTION

The present invention has as its object the provision of a combustion apparatus that detects combustible gasses other than carbon monoxide and can positively prevent the combustible gases from catching fire.

In a first aspect of the present invention, a combustion apparatus comprises a burner provided in a combustion chamber, a fan that takes in combustion air from an air supply port and supplies the combustion air to the burner, and combustion control means that ignites the burner after performing prepurge, which involves exhausting air from the combustion chamber by rotating the fan for a prescribed time. This combustion apparatus contains gas detection means that is provided between the air supply port and the fan and detects the concentration of a combustible gas, and the combustion control means ascertains, before starting the prepurge, whether a combustible gas of a preset maximum concentration or higher is detected by use of the gas detection means and prohibits the prepurge when a combustion gas of the preset maximum concentration or higher has been detected.

According to the first aspect, before starting the prepurge, the combustion control means detects the concentration of a combustible gas by use of the gas detection means provided between the air supply port and the fan and prohibits the prepurge when a combustible gas of the maximum concentration or higher has been detected. As a result of this, it is possible to positively prevent the fan from being energized when a combustible gas of the maximum concentration or higher is present in the vicinity of the air supply port of the combustion chamber, and the combustible gas from catching fire from an electric spark that might be generated in association with the energization.

In a second aspect of the present invention, a combustion apparatus comprises a burner provided in a combustion chamber, a fan that takes in combustion air from an air supply port and supplies the combustion air to the burner, and combustion control means that ignites the burner after performing prepurge, which involves exhausting air from the combustion chamber by rotating the fan for a prescribed time. This combustion apparatus contains gas detection means that is provided between the air supply port and the fan and detects the concentration of a combustible gas, and the combustion control means ascertains, during the prepurge, whether a combustible gas of a preset maximum concentration or higher is detected by use of the gas detection means and prohibits the ignition of the burner when a combustible gas of the maximum concentration or higher has been detected.

According to the second aspect, during the prepurge, the combustion control means detects the concentration of a combustible gas in combustion air taken in from the air supply port by use of the gas detection means provided between the air supply port and the fan and prohibits the ignition of the burner when a combustion gas of the maximum concentration or higher has been detected. As a result of this, it is possible to positively prevent the burner from being ignited when a combustible gas of the maximum concentration or more is present in the vicinity of the air supply port of the combustion chamber, and the combustible gas from catching fire.

It is preferred that the combustion control means ascertain, during the prepurge, whether a combustible gas which is in a range that is higher than a minimum concentration set lower than the maximum concentration and is lower than the maximum concentration is detected by use of the gas detection means, and perform the prepurge by extending the prescribed time when a combustible gas in a concentration in the prescribed range has been detected.

By performing control like this, even when the concentration of a combustible gas increases during the prepurge, it is possible to ascertain over a sufficient period of time whether the concentration of a combustible gas increases until the maximum concentration is exceeded. Therefore, it is possible to prevent more positively the combustible gas from catching fire due to the ignition of the burner.

If caution means is provided which arouses caution when a combustible gas in the prescribed range has been detected, it is possible to make it known to the user that a combustible gas in the prescribed range is present in the vicinity of the air supply port of the combustion apparatus. As a result of this, the user can take measures, such as the ventilation of the room, and can prevent the concentration of a combustible gas present in the vicinity of the combustion apparatus from becoming greater than the above-described maximum concentration.

DETAILED DESCRIPTION OF THE PREFERRED EMBODIMENTS

Figure 1:
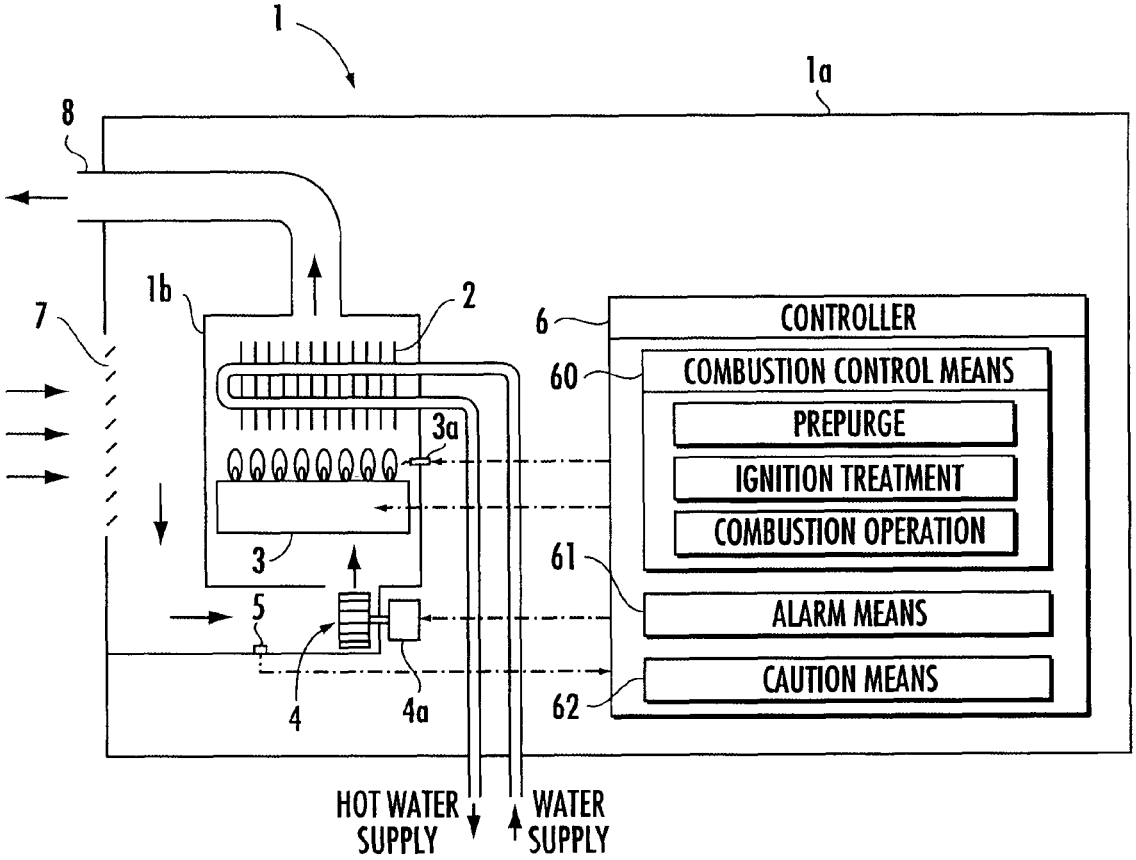
FIG. 1 is a schematic diagram that shows a combustion apparatus in an embodiment of the present invention.

The combustion apparatus in an embodiment of the present invention is a hot water supply apparatus of the roof top flue type (RF type), which is installed outdoor and uses the outside air as the combustion air of the burner. As shown in FIG. 1, the hot water supply apparatus 1 comprises, within a cabinet 1*a*, a burner 3 that heats a heat exchanger 2 by burning a fuel gas within a combustion chamber 1*b*, a fan 4 that supplies combustion air to the burner 3 by rotating a motor 4*a*, gas detection means 5 of the contact combustion type capable of detecting the concentration of a combustible gas, such as methane, propane, butane and pentane, and a controller 6 including combustion control means 60 that controls the combustion of the burner 3.

An air supply port 7 and an exhaust port 8 are provided on a side surface of the cabinet 1*a*, and combustion air of the burner 3 is taken in from the air supply port 7 by use of the fan 4. The gas detection means 5 is positioned between the air supply port 7 and the fan 4. The combustion chamber 1*b* communicates with the exhaust port 8, and a combustion exhaust gas burned by the burner 3 is exhausted from the exhaust port 8.

The combustion control means 60 of the controller 6 performs prepurge, which involves exhausting air from the combustion chamber 1*b* by rotating the fan 4 by the energization of the motor 4*a*, and thereafter performs combustion operation by igniting the burner 3 by use of an igniter 3*a*.

The controller 6 comprises alarm means 61 for giving the user an alarm indicating that a combustible gas is present by an alarm sound, by the lighting of an alarm lamp and the like when a combustible gas of a preset maximum concentration or higher has been detected by the gas detection means 5. Because of this, the user can take measures, such as the removal of an item that provides a source of generation of the combustible gas in the vicinity of the air supply port 7 and can further increase safety. The maximum concentration is set at a value lower than the concentration at which the combustible gas in question catches fire.

The controller 6 comprises caution means 62 for arousing caution by making it known to the user by an unillustrated caution buzzer, by the lighting of an unillustrated caution lamp and the like that a combustion gas which is in a range that is higher than a minimum concentration set lower than the maximum concentration and is lower than the maximum concentration has been detected during combustion operation by the gas detection means 5 when this combustible gas in the range has been detected. Because of this, when there is an item that causes the generation of a combustible gas, such as a tank of a volatile fuel, such as gasoline, in the vicinity of the air supply port 7, the user can take measures, such as the removal of the item, and can prevent the concentration of the combustible gas present in the vicinity of the air supply port 7 from becoming greater than the maximum concentration.

Figure 2:
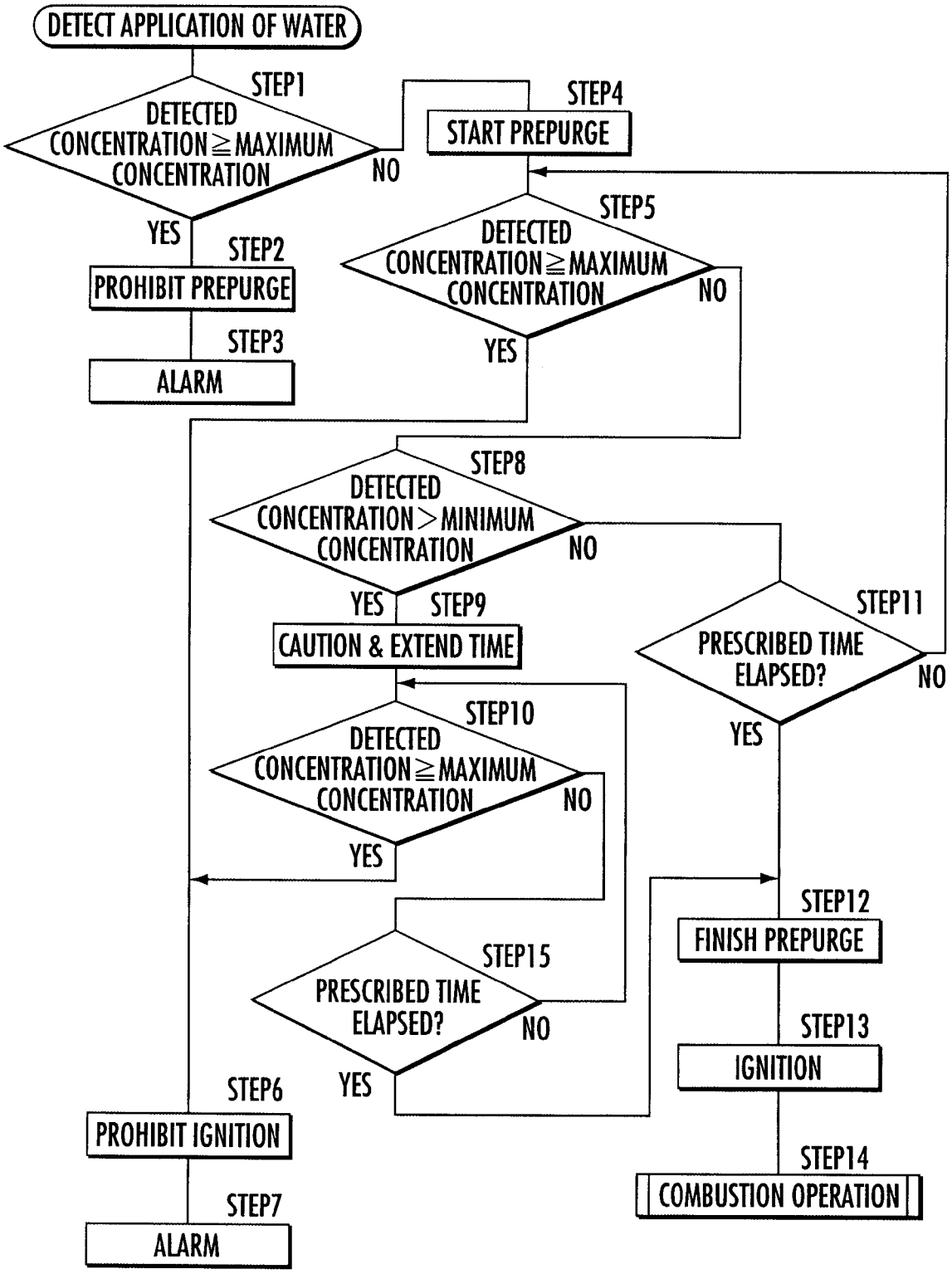
FIG. 2 is a flow chart that shows the control of this embodiment.

Next, the operation of the controller 6 will be described with reference to FIG. 2.

When the application of water to the hot water supply apparatus 1 has been detected by a water application sensor that is not illustrated, the combustion control means 60 of the controller 6 ascertains at STEP 1 whether a combustible gas of the maximum concentration or higher is detected by the gas detection means 5. When a combustible gas of the maximum concentration or higher has been detected, the operation proceeds to STEP 2, at which the combustion control means 60 prohibits prepurge without allowing the energization of the motor 4*a*. And at STEP 3, the alarm means 61 gives an alarm to the user. As a result of this, it is possible to positively prevent the combustible gas from catching fire from an electric spark that might be generated in association with the energization of the motor 4*a* and the ignition of the burner 3 by the igniter 3*a*.

When a combustible gas of the maximum concentration or higher has not been detected by the gas detection means 5 at STEP 1, the operation proceeds to STEP 4 in a branching manner, and the combustion control means 60 starts prepurge, which involves exhausting air from the combustion chamber 1*b* by rotating the fan 4 for a prescribed time. And at STEP 5, the combustion control means 60 ascertains, during the prepurge, whether a combustible gas of the maximum concentration or higher is detected by use of the gas detection means 5. When a combustible gas of the maximum concentration or higher has been detected, the operation proceeds to STEP 6, at which the combustion control means 60 prohibits the ignition of the burner 3. And at STEP 7, the alarm means 61 gives an alarm to the user. As a result of this, it is possible to positively prevent the combustible gas from catching fire in association with the ignition of the burner 3.

On the other hand, when a combustible gas of the maximum concentration or higher has not been detected by the gas detection means 5 at STEP 5, the operation proceeds to STEP 8 in a branching manner, and the combustion control means 60 ascertains whether a combustible gas which is in a range that is higher than a minimum concentration (for example, 0%) set lower than the maximum concentration and is lower than the maximum concentration is detected by use of the gas detection means 5. When a combustible gas in the range has been detected, the operation proceeds to STEP 9, at which the caution means 62 arouses the user's caution and the combustion control means 60 extends the prescribed time for which prepurge is performed.

Next, at STEP 10, the combustion control means 60 ascertains within the extended, prescribed time whether a combustible gas of the maximum concentration or higher is detected by the gas detection means 5. When a combustible gas of the maximum concentration or higher has been detected, the operation proceeds to STEP 6, at which the combustion control means 60 prohibits the ignition of the burner 3. By ensuring that the prescribed time is extended like this at STEP 9, even when the concentration of a combustible gas increases during the prepurge, it is possible to ascertain over a sufficient period of time whether the concentration of a combustible gas increases until the maximum concentration is exceeded. Therefore, it is possible to prevent more positively the combustible gas from catching fire due to the ignition of the burner 3.

When the concentration of a combustible gas detected by the gas detection means 5 at STEP 8 is not in the range that is higher than a minimum concentration set lower than the maximum concentration and is lower than the maximum concentration, the operation proceeds to STEP 11 in a branching manner, and the combustion control means 60 ascertains whether the prescribed time has elapsed. When the prescribed time has elapsed, the operation proceeds to STEP 12, at which the combustion control means 60 finishes the prepurge. At STEP 13 the burner 3 is ignited by the igniter 3*a*, and at STEP 14 the combustion operation of the burner 3 is performed. On the other hand, when the prescribed time has not elapsed at STEP 11, the operation returns to STEP 5.

When a combustible gas of the maximum concentration or higher has not been detected at STEP 10, the operation proceeds to STEP 15 in a branching manner, and the combustion control means 60 ascertains whether the extended, prescribed time has elapsed. The operation proceeds to STEP 12 when the extended, prescribed time has elapsed, and the operation returns to STEP 10 when the extended, prescribed time has not elapsed.

Figure 3:
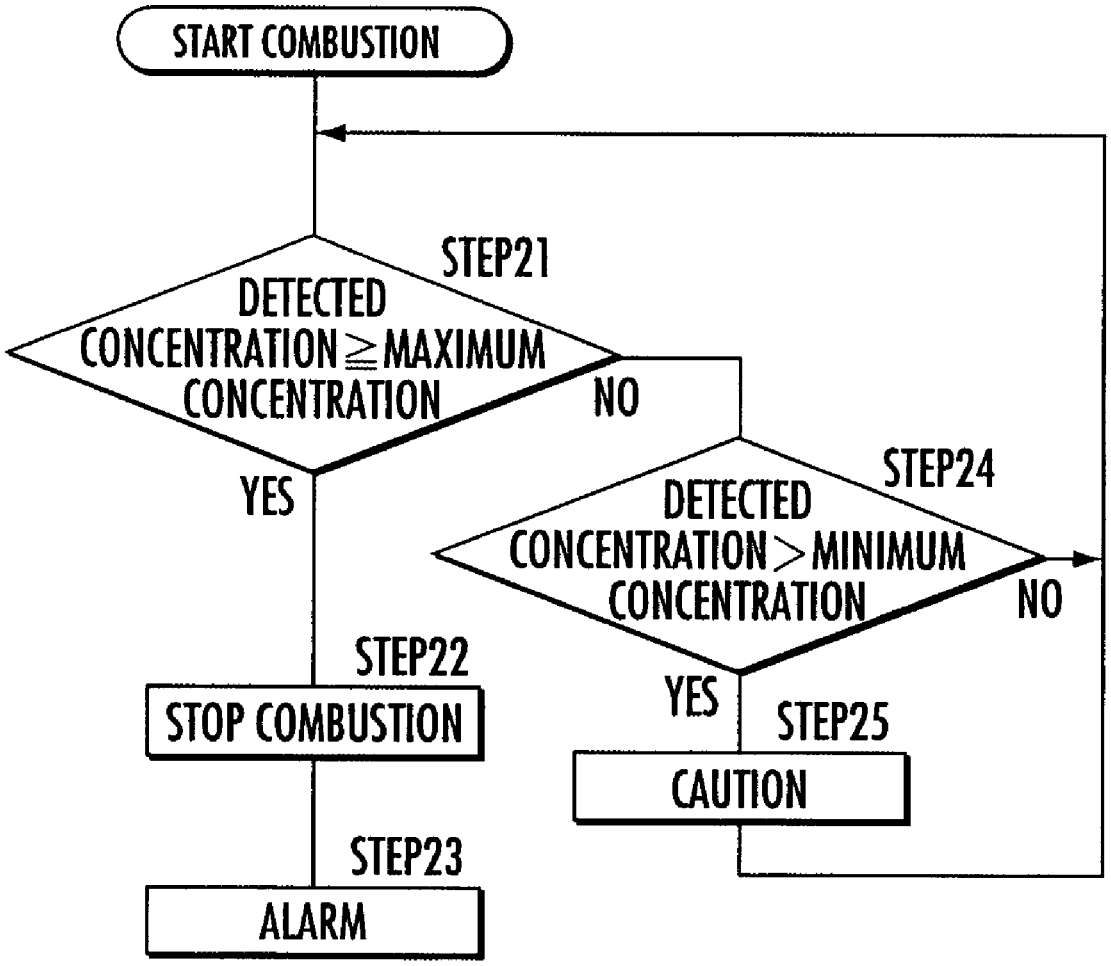
FIG. 3 is a flow chart that shows the control of combustion operation of this embodiment.

Next, the operation of the controller 6 during combustion operation will be described with reference to FIG. 3.

When combustion operation has been started, the combustion control means 60 ascertains at STEP 21 whether a combustible gas of the maximum concentration or higher is detected by use of the gas detection means 5. When a combustible gas of the maximum concentration or higher has been detected, the operation proceeds to STEP 22, at which the combustion control means 60 stops the combustion of the burner 3 by interrupting the fuel gas being supplied to the burner 3. And at STEP 23, the alarm means 61 gives an alarm to the user.

When a combustible gas of the maximum concentration or higher has not been detected by the gas detection means 5 at STEP 21, the operation proceeds to STEP 24 in a branching manner, and the combustion control means 60 ascertains whether a combustible gas which is in a range that is higher than a minimum concentration set lower than the maximum concentration and is lower than the maximum concentration is detected. When a combustible gas of the concentration in the range has been detected, the operation proceeds to STEP 25, at which the caution means 62 arouses the user's caution and the operation returns to STEP 21. Because of this, the user can take measures, such as the removal of an item that provides a source of generation of the combustible gas in the vicinity of the air supply port 7, and can prevent the concentration of the combustible gas present in the vicinity of the air supply port 7 from becoming higher than the maximum concentration. On the other hand, when a combustible gas of the maximum concentration or higher has not been detected at STEP 24, the operation returns to STEP 21.

According to the hot water supply apparatus 1 of this embodiment, even when a combustible gas is present in the vicinity of the air supply port 7, by use of the gas detection means 5 disposed between the air supply port 7 and the fan 4, it is possible to detect the concentration of a combustible gas that has entered from the air supply port 7, and it is possible to positively prevent a combustible gas from caching fire.

In this embodiment, the description has been made of a case where a hot water supply apparatus of the roof top flue type (RF type), which is installed outdoor and uses the outside air as the combustion air of the burner, is used as the combustion apparatus. However, the present invention is not limited to this, and the effects of the present invention can also be obtained similarly in a hot water supply apparatus of an indoor installation type, such as the forced draft balanced flue type (FF type) and the forced exhaust type (FE type).

What is claimed is:

1. A combustion apparatus, comprising:

a burner provided in a combustion chamber;

a fan that takes in combustion air from an air supply port and supplies the combustion air to the burner;

a combustion control means that ignites the burner after performing prepurge, which involves exhausting air from the combustion chamber by rotating the fan for a prescribed time prior to igniting the burner; and a gas detection means that is provided between the air supply port and the fan and detects the concentration of a combustible gas, wherein the combustion control means ascertains, before starting the prepurge, whether a combustible gas of a preset maximum concentration or higher is detected by use of the gas detection means and prohibits the prepurge when a combustible gas of the maximum concentration or higher has been detected, wherein the maximum concentration is set lower than a concentration at which gas ignites.

2. A combustion apparatus, comprising:

a burner provided in a combustion chamber;

a fan that takes in combustion air from an air supply port and supplies the combustion air to the burner;

a combustion control means that ignites the burner after performing prepurge, which involves exhausting air from the combustion chamber by rotating the fan for a prescribed time prior to igniting the burner; and a gas detection means that is provided between the air supply port and the fan and detects the concentration of a combustible gas in combustion air, wherein the combustion control means ascertains, during the prepurge, whether a combustible gas of a preset maximum concentration or higher is detected by use of the gas detection means and prohibits the ignition of the burner when a combustible gas of the maximum concentration or higher has been detected, wherein the maximum concentration is set lower than a concentration at which gas ignites.

3. The combustion apparatus according to claim 2, wherein the combustion control means ascertains, during the prepurge, whether a combustible gas which is in a range that is higher than a minimum concentration set lower than the maximum concentration and is lower than the maximum concentration is detected by use of the gas detection means, and performs the prepurge by extending the prescribed time when a combustible gas in a concentration in the range has been detected.

4. The combustion apparatus according to claim 3, wherein the combustion apparatus further comprises caution means for arousing caution when a combustible gas in the range has been detected.

* * * * *